US007470335B2

(12) United States Patent
Toller et al.

(10) Patent No.: US 7,470,335 B2
(45) **Date of Patent: *Dec. 30, 2008**

(54) METHOD OF MODIFYING A WORKPIECE FOLLOWING LASER SHOCK PROCESSING

(75) Inventors: Steven M. Toller, Dublin, OH (US); Allan H. Clauer, Worthington, OH (US); Jeff L. Dulaney, Delaware, OH (US)

(73) Assignee: LSP Technologies, Inc., Dublin, OH (US)

( * ) Notice: Subject to any disclaimer, the term of this patent is extended or adjusted under 35 U.S.C. 154(b) by 469 days.

This patent is subject to a terminal disclaimer.

(21) Appl. No.: 11/023,228

(22) Filed: Dec. 27, 2004

(65) Prior Publication Data

US 2005/0211343 A1 Sep. 29, 2005

Related U.S. Application Data

(63) Continuation of application No. 09/590,866, filed on Jun. 9, 2000, now Pat. No. 6,852,179.

(51) Int. Cl.
*C21D 1/09* (2006.01)

(52) U.S. Cl. ..... 148/525; 148/565

(58) Field of Classification Search ..... 148/525, 148/565

See application file for complete search history.

(56) References Cited

U.S. PATENT DOCUMENTS 5,671,628 A * 9/1997 Halila et al. ..... 72/53
6,551,064 B1 * 4/2003 Mannava et al. ..... 416/223 A
6,852,179 B1 * 2/2005 Toller et al. ..... 148/525

* cited by examiner

*Primary Examiner*—George Wyszomierski
(74) *Attorney, Agent, or Firm*—Benesch, Friedlander, Coplan & Aronoff LLP

(57) ABSTRACT

A method of manufacturing a workpiece involves performing any one of various post-processing part modification steps on a workpiece that has been previously subjected to laser shock processing. In one step, material is removed from the compressive residual stress region of the processed workpiece. Alternately, the workpiece may be provided with oversized dimensions such that the removal process removes an amount of material sufficient to generate a processed workpiece having dimensions substantially conforming to design specifications. Alternately, the material removal process is adapted to establish a penetration depth for material removal that coincides with the depth at which the workpiece exhibits maximum compressive residual stress. Alternately, a first high-intensity laser shock processing treatment is performed on the workpiece, followed by the removal of material from the compressive residual stress region, and then a second low-intensity laser shock processing treatment is performed on the workpiece. Material may be removed from the compressive residual stress region through a workpiece surface different from the laser shock processed surface. Material may also be deposited onto the laser shock processed surface.

35 Claims, 10 Drawing Sheets

METHOD OF MODIFYING A WORKPIECE FOLLOWING LASER SHOCK PROCESSING

CONTINUATION DATA

This application claims the benefit of priority under 35 U.S.C. §120 as a continuation of U.S. patent application Ser. No. 09/590,866 filed Jun. 9, 2000 now U.S. Pat. No. 6,852,179, which is explicitly incorporated herein by reference thereto.

BACKGROUND OF THE INVENTION

1. Field of the Invention

The present invention relates to a laser shock processing operation, and, more particularly, to a method and apparatus for modifying a workpiece previously subjected to a laser shock processing treatment, such as by removing material from, or adding material to, the laser shock processed region.

2. Description of the Related Art

The use of laser shock processing has found wide success, particularly in applications involving the enhancement of certain structural features such as the leading and trailing edges of airfoils in integrally bladed rotor systems. However, the high levels of compressive residual stresses that accompany laser shock processing may at times produce unique features in a processed workpiece. Recognition of the occurrence of one or more of these features has underpinned various efforts to examine the extent to which such processing can be modified to mitigate or remove these features, if they prove to be undesirable in a particular application.

Laser shock processing can leave surface geometry irregularities such as surface roughness and partially rolled-over or extruded edges, and other undesirable features. The surface roughness may, for example, take the form of laser-beam-spot depressions, surface melt or 'staining', pits from collapsed sub-surface porosity in castings, and beaded surface patterns. The surface roughness created by laser shock peening can vary from none to 0.001 to 0.002 inches in depth. Surface roughness as little as 0.0005 inches is a concern in certain applications such as airfoils, or polished surfaces. Laser shock peening may also cause some distortion in the shape of the part due to the compressive residual stresses created. This may necessitate smoothing the surface of airfoils of aircraft gas turbine engine blades and integrally bladed rotors (IBRs) after laser peening or shot peening at high intensities. This may be desirable to increase the aerodynamic efficiency of the airfoils after processing. In addition, the performance of some parts is degraded by required manufacturing steps, for example, certain machining operations that leave a rough surface, or intensive shot peening.

In view of the foregoing, there is needed a material treatment process that eliminates undesirable distortion and surface roughness introduced by conventional manufacturing processes or laser shock processing, without sacrificing the benefits of such processing.

SUMMARY OF THE INVENTION

According to the present invention there is provided a method for manufacturing and processing a workpiece that involves performing any one of various post-processing part modification steps on a fabricated workpiece that has been previously subjected to laser shock processing.

One part modification procedure involves removing material from at least a portion of the compressive residual stress region previously produced by laser shock processing the workpiece. In one form, the fabricated workpiece is provided with oversized dimensions such that the removal process is adapted to remove an amount of material sufficient to generate a processed workpiece having dimensions substantially conforming to design specifications.

In another form, the material removal process is adapted to remove a localized tensile stress region sometimes present immediately beneath part of the laser shock processed surface.

In another form, the material removal process is adapted to establish a penetration depth for material removal that coincides with the depth at which the workpiece exhibits maximum compressive residual stress.

In another form, a first laser shock processing treatment is performed on the workpiece at a high-intensity energy level, material is removed from the compressive residual stress region of the processed workpiece, and a second laser shock processing treatment is performed on the processed workpiece.

In another form, material is removed from the compressive residual stress region through a workpiece surface (preferably un-processed) that is different from the laser shock processed surface.

According to another category of part modification procedures, material is deposited onto the laser shock processed surface in the form of a material deposition layer. Some of this layer will then be removed to form a smooth surface.

As used herein, and well known by those skilled in the art, laser shock processing (LSP), laser shock peening, or laser peening as it is also referred to, is a process for producing a region of deep compressive residual stresses in the workpiece induced by the presence of traveling pressure or shock waves that are imparted to the surface by laser shock peening. This form of treatment utilizes a laser beam from a laser beam source to produce a strong localized compressive force on a portion of the workpiece surface by precipitating an explosive force caused by instantaneous ablation or vaporization of a painted, coated, or un-coated surface.

In one typical form, laser peening employs two surface overlays: a transparent overlay (usually a flowing film of water) and an opaque overlay, such as an oil-based or acrylic-based black paint. During processing, a laser beam is directed to pass through the water overlay to enable the energy to become absorbed by the black paint, causing a rapid vaporization of the paint surface, which is sufficient to generate a high-amplitude shock wave. The water film acts as a confining agent that contains and redirects the shock waves into the body of the workpiece, thereby acting to cold-work the surface of the part and to create compressive residual stresses extending from the surface into the interior of the part.

The workpiece is typically treated by developing a matrix of overlapping or non-overlapping laser beam spots that cover a critical zone of interest. Additionally, the same or adjacent areas may be repeatedly processed by cyclically directing energy pulses to the desired target area. Various parameters may be controlled by the production manager, design engineer, or operator to tailor the laser shock processing operation. For example, the operational parameters that the designer can select and adjust include (but are not limited to) the location of the incident beam spot; number of, and spacing between, spots; distance of spots from certain workpiece features (e.g., leading and trailing edge of an airfoil on an integrally bladed rotor); angle of incidence of the laser pulse; laser pulse width and repetition; and beam intensity.

Additional descriptions may be found in U.S. Pat. Nos. 5,741,559 and 5,911,890, both assigned to the same assignee as the present application and incorporated herein by reference thereto. U.S. Pat. No. 5,131,957 is also incorporated herein by reference thereto.

The advantage of laser shock processing relates to its ability to increase the fatigue properties of the part by selectively developing pre-stressed regions within certain critical areas where incipient flaws or cracks typically appear. The technique has been applied with favorable success to the processing of the pressure and suction sides of leading and trailing edges of fan and compressor airfoils and blades in gas turbine engines.

The various effects of laser peening on the fatigue properties of welded samples has been reported in "Shock Waves and High Strain Rate Phenomena in Metals" by A. H. Clauer, J. H. Holbrook and B. P. Fairand, Ed. by M. S. Meyers and L. E. Murr, Plenum Press, N.Y. (1981), pp. 675-702 (incorporated herein by reference thereto).

As used herein, a workpiece refers to any solid body, article, or other suitable material composition that is capable of being treated by laser shock processing. The workpiece may represent a constituent piece forming part of an in-production assembly, a final production article, or any other desired part. Accordingly, the laser shock processing treatment may be applied at any stage of production, i.e., pre- or post-manufacturing or any intervening time. Preferably, in certain industrial applications, the present invention finds significant use in processing the airfoils of an integrally bladed rotor, most notably in the region proximate the leading and trailing edges of airfoils where flaws and other high-cycle failures pose serious problems affecting the performance and durability of the engine.

The invention, in one form thereof, is directed to a method of processing a workpiece. According to the method, a workpiece is laser shock processed to produce a processed workpiece having at least one laser shock processed region. The laser shock peening roughens the surface of the surface with one or more depressions having a depth ranging of 0.0005 to 0.002 inches. Material is removed from at least one laser shock processed region of the processed workpiece to remove the depressions and bring the surface into substantial compliance with predetermined dimensional and and/or surface finish workpiece requirements. This would be a consideration when the depressions are deeper than 0.0005 inches. In this example of the method, 0.0005 inches or greater amounts of material would be removed, thereby making a substantially smooth surface. The laser shock processed region has compressive residual stresses extending into the processed workpiece from a laser shock processed surface thereof. In one form, the material removal step removes material from the laser shock processed surface.

The method further includes the steps of determining a penetration depth into the processed workpiece at which at least one selective compressive residual stress level is present; and defining a subsurface of the processed workpiece representative of the determined penetration depth. The material removal step is sufficient to expose at least a portion of the defined subsurface.

The material removal step, in another form, is sufficient to remove at least one present residual tensile stress feature from the laser shock processed region. In yet another form, the material removal step removes an amount of material sufficient to produce in the processed workpiece at least one selected dimensional characteristic.

The method further includes the step of laser shock processing the processed workpiece following completion of the material removal step, wherein laser shock processing of the processed workpiece is performed at a second energy level different from a first energy level associated with the initial laser shock processing step which produced the processed workpiece. The first energy level is preferably greater than the second energy level.

In another form of the method, the laser shock processed region extends into the workpiece from a first surface thereof, wherein the first workpiece surface has at least one laser shock processed portion. The material removal step removes material from the at least one laser shock processed portion of the first workpiece surface.

Alternately, the material removal step removes material from a second surface different from the first surface. The second workpiece surface preferably has at least one portion substantially unaffected by the laser shock processing step.

The invention, in another form thereof, is directed to a method of processing a workpiece. According to the method, a workpiece is laser shock processed to produce a processed workpiece having at least one laser shock processed region. Material is deposited on at least a portion of the laser shock processed region of the processed workpiece. A portion of the deposited material is then removed to bring at least one dimensional characteristic into substantial compliance with the specification.

The material deposition step includes, in various forms, the step of performing at least one of flame-sprayed coating, plasma-sprayed coating, chemical plating, electro-plating, chemical vapor deposition and vacuum deposition.

According to various implementations of the processing method, the workpieces may include, without limitation, a gas turbine engine component, a mold, and a die.

In alternative forms, the material removal step includes the step of performing at least one of grinding, sanding, mechanical milling, chemical milling, electrochemical milling, chemical etching, polishing, and thermally treating the processed workpiece.

The invention, in another form thereof, is directed to a method comprising, in combination, the steps of providing a workpiece having at least one dimensional characteristic exceeding a specification; laser shock processing the workpiece to produce a processed workpiece having a laser shock processed region, wherein at least part of the at least one dimensional characteristic of the workpiece lies within the laser shock processed region; and removing material from the laser shock processed region in a manner sufficient to bring the at least one dimensional characteristic of the workpiece into substantial compliance with the specification.

The invention, in another form thereof, is directed to an article manufactured by a process, wherein the article has an exposed surface and an unexposed subsurface portion. The process involves laser shock processing the article to produce a processed article having at least one laser shock processed region; and removing material from the at least one laser shock processed region of the processed article to expose at least the subsurface portion of the article. The laser shock processed region has compressive residual stresses extending into the processed article from a laser shock processed surface thereof.

In one form, the material removal step induces a stress relaxation effect in the processed article, causing a modification in the mechanical equilibrium condition at and beneath the exposed subsurface portion of the article.

In another form, the material removal step induces a change in the compressive residual stress characteristics at the exposed subsurface portion of the article. In particular, the material removal step induces an increase in the surface compressive residual stress characteristics at the exposed subsurface portion of the article.

In yet another form, the material removal step is sufficient to remove at least one present residual tensile stress feature from the laser shock processed region.

The invention, in yet another form thereof, is directed to an article manufactured by a process, wherein the article has an exposed surface and an unexposed subsurface portion. The process involves laser shock processing the article to produce a processed article having at least one laser shock processed region; and depositing material on at least a portion of the at least one laser shock processed region of the processed article; then removing a portion of the deposited material to bring at least one dimensional characteristic into substantial compliance with the specification.

One advantage of the present invention is that the various part modification steps enable surface irregularities and deformations to be eliminated without materially sacrificing any of the beneficial effects of laser shock processing.

Another advantage of the present invention is that post-processing removal of material from the compressive residual stress region of the processed workpiece enables the designer to make selective changes to the residual stress characteristics of the workpiece and improve the fatigue properties thereof.

Another advantage of the present invention is that the various part modification steps occur as part of a post-processing activity, allowing the designer to adapt the material removal and material deposition processes to remedy any physical disturbances introduced by the laser shock processing treatment.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

By way of overview, the various processing methods disclosed herein involve processing activities that are preferably executed upon a workpiece, article, or other such part following the performance of a laser shock processing operation on the workpiece. Stated otherwise, the various part modification procedures disclosed herein are carried out on a previously processed workpiece.

The manner of conducting such laser shock processing does not form an essential part of the present invention as it should be apparent that the workpiece can be subjected to any suitable type of laser peening conditions. Additionally, the processed condition of the workpiece may be generated in accordance with any activity involving, inter alia, laser shock processing, shot peening, the application of a force or pressure field to the workpiece, or the development of stress regions within the workpiece.

The various part modification procedures of the present invention individually endeavor in a general way to configure or otherwise render the subject workpiece into a final finished form that exhibits, inter alia, the substantial absence of surface irregularities, deformations, and other such distortion features; substantial conformity of the geometry and other dimensional characteristics of the finished workpiece to predetermined specifications; and a compressive residual stress profile having robust characteristics in the regions of interest, e.g., a peak compressive residual stress value immediately adjacent the workpiece surface within a fatigue critical zone.

Figure 1:
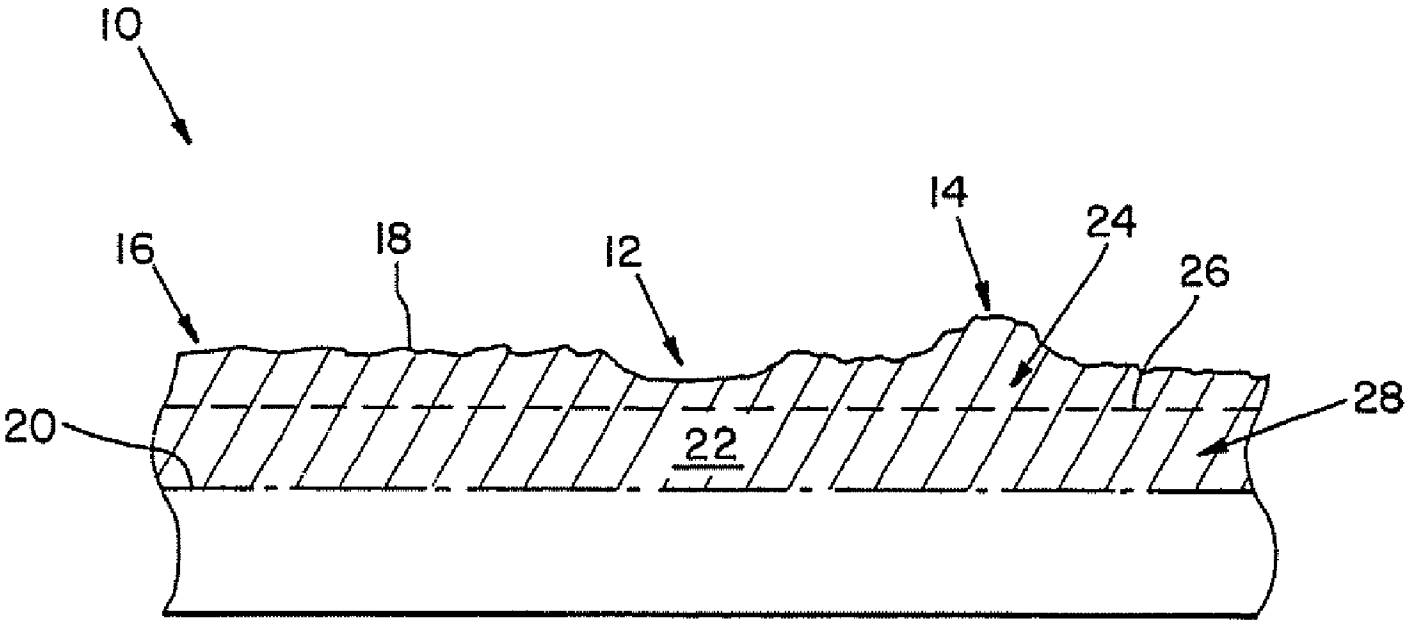
FIG. 1 is a fragmentary, side-elevational schematic view of a representative workpiece illustrating in exaggerated form a type of distortion that is removed according to one embodiment of the present invention.
Figure 2:
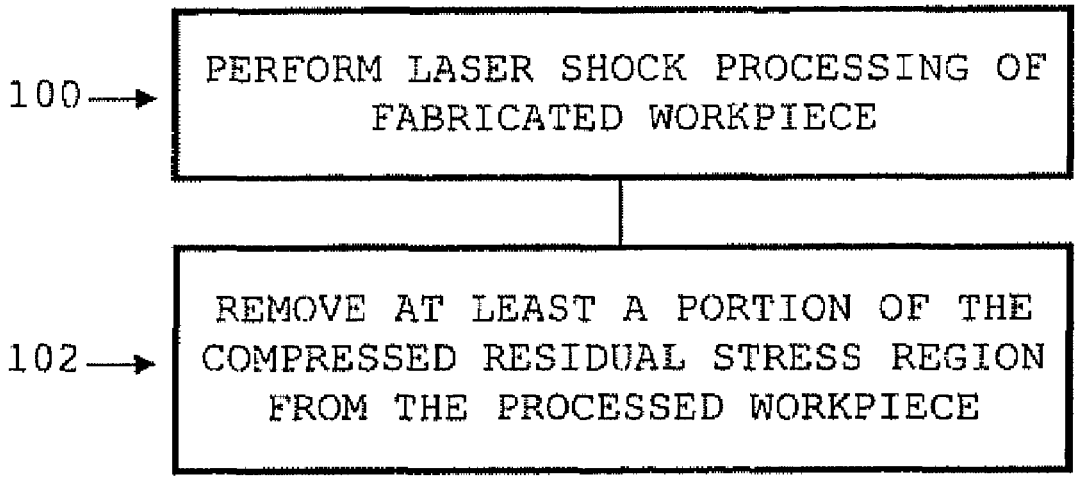
FIG. 2 is a flowchart of the processing method disclosed in FIG. 1.

Referring now to the drawings, and particularly to FIG. 1, there is shown a representative workpiece 10 depicting the manner of eliminating a type of distortion illustrated in exaggerated form as recess or dimple 12 and a bump or elevated portion 14, according to one embodiment of the present invention. Reference is also made to the flowchart of FIG. 2 depicting the operating sequence of the part modification procedure.

The illustrated workpiece 10 has previously been subject to laser shock processing at side 16 to produce a laser shock processed surface area 18 having the indicated distortion features 12 and 14 introduced in a known manner by the completed laser shock processing activity (step 100). As conventionally known, the laser shock processing induces the formation of deep compressive residual stresses extending from surface 18 into the body of workpiece 10 and reaching a penetration depth illustratively designated by first subsurface 20, thereby defining an illustrative compressive residual stress region 22 between first subsurface 20 and exposed surface 18.

According to one aspect of the present invention, a part modification procedure is implemented with respect to workpiece 20 that involves the removal of at least a portion of compressed residual stress region 22 in a manner adequate to selectively eliminate the surface irregularities or imperfections such as distortion features 12 and 14 (step 102). In particular, a second subsurface 26 is chosen that will form the exposed surface of processed workpiece 10 following completion of the material removal procedure. The manner of arranging second subsurface 26 as the new surface of workpiece 10 involves removing an amount of material from processed workpiece 10 that is contained within and represented by surface layer 24 disposed between surface 18 and second subsurface 26.

As shown, second subsurface 26 is preferably disposed intermediate surface 18 and first subsurface 20 (i.e., subsurface 26 lies above subsurface 20) such that a portion 28 of stress region 22 will remain following completion of the material removal step.

The manner of removing material from stress region 22 of workpiece 10 is preferably conducted with a view toward developing a new surface (i.e., previously subsurface 26) that is polished or otherwise configured in a finished form substantially free of surface defects. The as-modified workpiece 10 is now preferably ready for further assembly (if a component part) or installation in the field (if already arranged in a finished product). Additionally, it should be apparent that any suitable method may be used to perform the material removal procedure, including, but not limited to, grinding, sanding, mechanical milling, abrading, chemical milling, electrochemical milling, chemical etching, and thermal treatment.

A removal process having minimal target area impact is preferred (such as chemical milling), since unlike mechanical-type treatments it does not impart any mechanical stresses, added residual stresses, or surface effects. As conventionally known, chemical milling treats the workpiece with a chemical reagent that reacts with the surface layer 24 to easily facilitate its removal. It should also be apparent that the form and extent of second subsurface 26 is shown for illustrative purposes only since other subsurface portions may be chosen for exposure and attendant designation as the new surface layer of workpiece 10.

Figure 3:
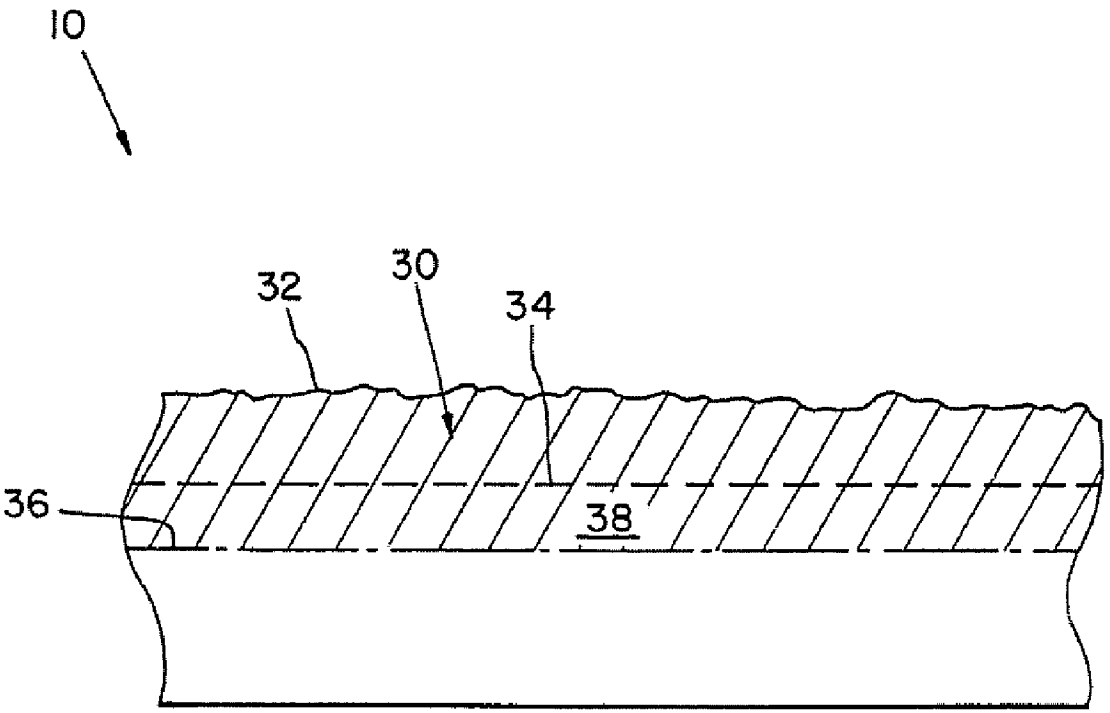
FIG. 3 is a fragmentary, side-elevational schematic view of a representative workpiece illustrating the manner of removing material from the processed workpiece to render it compliant with predetermined dimensional specifications, according to another embodiment of the present invention.
Figure 4:
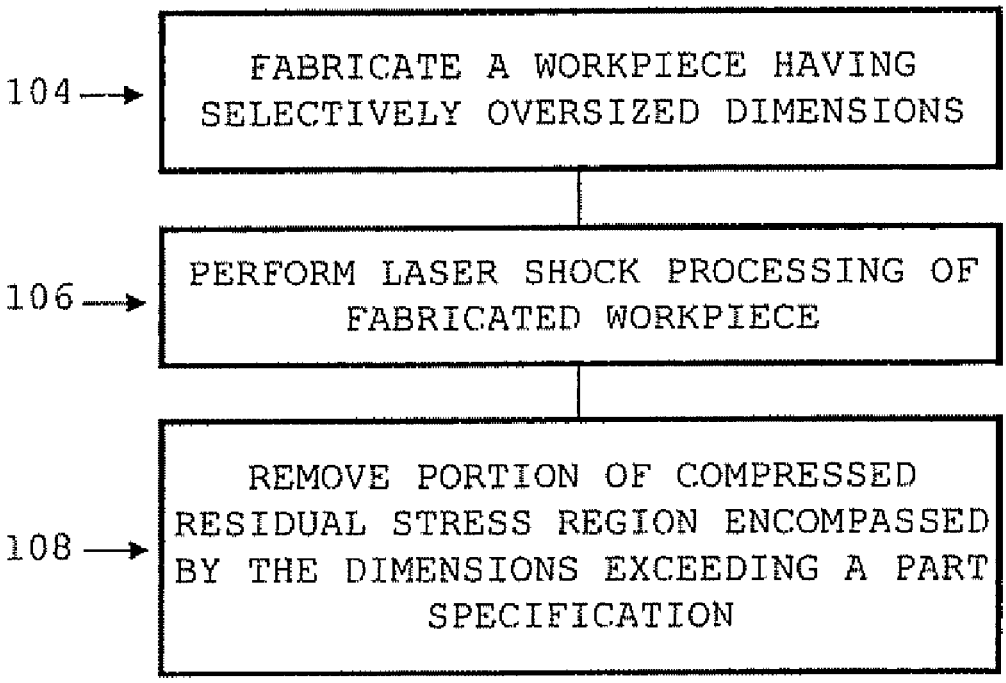
FIG. 4 is a flowchart of the processing method disclosed in FIG. 3.

Referring now to FIG. 3, there is shown a lateral schematic view of representative workpiece 10 provided with an upper buffer layer (illustrated at 30) defined between surface 32 and a first subsurface 34 of predetermined location, according to another embodiment of the present invention. Reference is also made to the flowchart of FIG. 4 depicting the operating sequence of the part modification procedure illustrated by FIG. 3.

As explained below, the upper buffer layer 30 is formed as part of a design fabrication effort aimed at providing workpiece 10 with oversized dimensions relative to normal part specifications (step 104). The particular construction of workpiece 10 can be developed using any conventional fabrication techniques known to those skilled in the art.

Fabricated workpiece 10 is subjected to a laser shock processing operation to conventionally produce laser shock processed surface area 32 (step 106). The laser shock processing induces the formation of deep compressive residual stresses extending from surface 32 into the body of workpiece 10 and reaching a penetration depth illustratively designated by second subsurface 36, thereby defining an illustrative compressive residual stress region 38 between second subsurface 36 and exposed surface 32.

Following laser shock processing, the processed workpiece 10 is further treated by removing a portion of stress region 38 corresponding to the material contained within buffer layer 30, thereby exposing first subsurface 34 as the new surface of workpiece 10 (step 108). According to another aspect of the present invention, first subsurface 34 corresponds to a desired final dimensional feature of workpiece 10 that conforms to design specifications or other production criteria for workpiece 10.

In effect, workpiece 10 is fabricated in an oversized configuration as exemplified by buffer layer 30 such that following removal of the material in buffer layer 30, the final form of workpiece 10 will exhibit a dimensional characteristic (defined by surface 34) that complies with certain specifications (step 104). This removal step therefore functions to remove the portion of compressed residual stress region 38 that is encompassed by the workpiece dimensions which exceed a part specification (step 108).

The specific parameters for buffer layer 30 (such as depth and coverage area) are preferably chosen such that the laser shock processing will develop a stress region 38 that adequately extends beneath subsurface 34. For example, the fabrication of buffer layer 30 may be tailored such that a peak compressive residual stress is developed beneath surface 32 at a depth substantially aligned with subsurface 34. As a result, following part modification (i.e., removal of buffer layer 30), the processed workpiece 10 will advantageously possess peak compressive stress levels in the critical zone immediately adjacent its surface to thereby enhance the retardation of crack propagation, for example.

Figure 5:
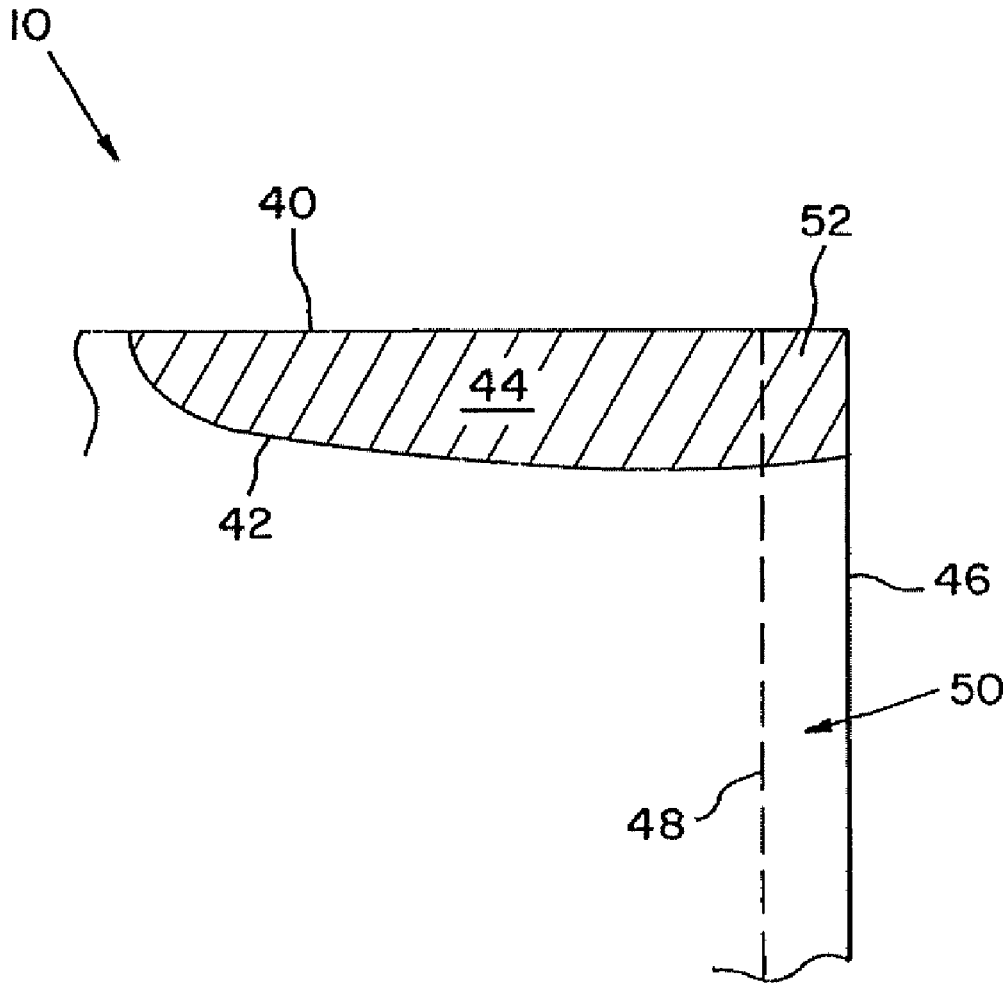
FIG. 5 is a fragmentary, side-elevational schematic view of a representative workpiece illustrating the manner of removing material from the processed workpiece by accessing the laser shock processed region through an unprocessed surface, according to another embodiment of the present invention.
Figure 6:
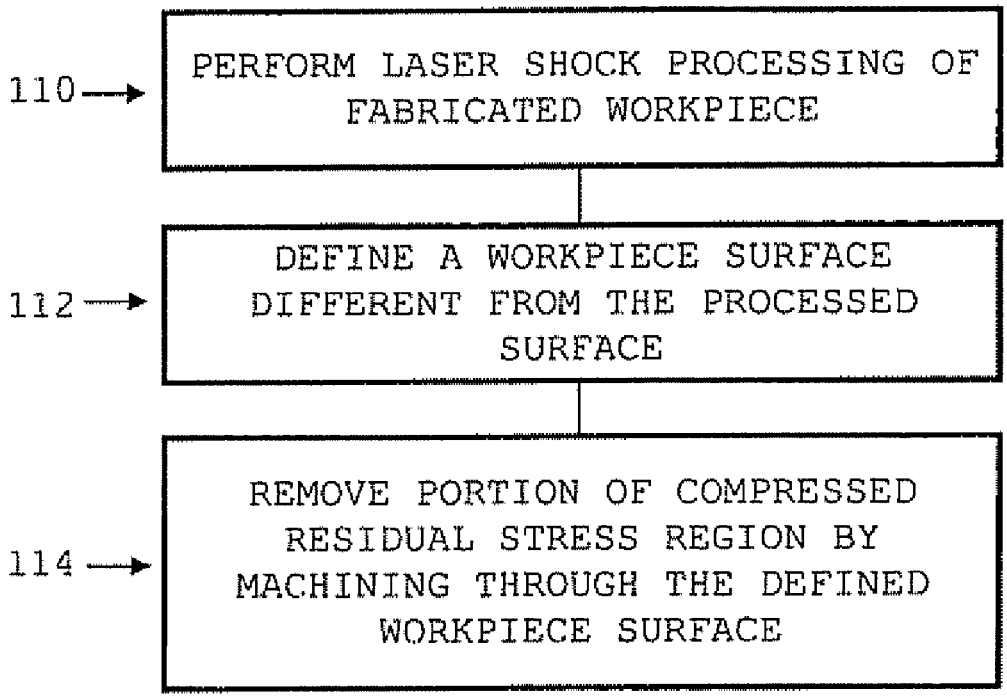
FIG. 6 is a flowchart of the processing method disclosed in FIG. 5.

Referring to FIG. 5, there is shown a fragmentary schematic view of a representative workpiece 10 illustrating the manner in which the removal of a portion of a laser shock processed region occurs via penetration through a non-processed surface area, according to another embodiment of the present invention. Reference is also made to the flowchart of FIG. 6 depicting the operating sequence of the part modification procedure illustrated by FIG. 5.

Fabricated workpiece 10 is subjected to a laser shock processing operation to conventionally produce laser shock processed surface area 40 (step 110). The laser shock processing induces the formation of deep compressive residual stresses extending from surface 40 into the body of workpiece 10 and reaching a penetration depth illustratively designated by first subsurface 42, thereby defining an illustrative compressive residual stress region 44 between first subsurface 42 and exposed surface 40.

Following laser shock processing, the processed workpiece 10 is further treated by removing a portion of workpiece 10 lying subjacent to surface 46 and extending to second subsurface 48. This removed portion is illustratively depicted at 50. For this purpose, the part modification procedure involves the definition of a workpiece surface 46 different from the laser shock processed surface 40 (step 112). Associated with this definition of workpiece surface 46 is the companion definition of a subsurface 48 associated therewith, which together define a workpiece portion 50 subject to removal that encompasses at least a portion 52 of residual compressed stress region 44.

As shown, this removal of portion 50 has the effect of removing a portion 52 of stress region 44 bounded by first subsurface 42, second subsurface 48, processed surface 40, and surface 46. The removal procedure accesses processed portion 52 of stress region 44 by penetrating through surface 46, e.g., by a machining or milling operation (step 114). This removal mechanism differs from FIGS. 1 and 3 in which the respective stress regions are accessed directly through laser shock processed surface areas associated with the stress regions.

Surface 46 is preferably unprocessed by the laser shock processing activity chiefly directed at surface 40. In one form, no part of surface 46 is affected by the laser shock processing that is directed at surface 40 or any other part of workpiece 10. In particular, the energy pulses directed toward workpiece 10 to induce the stress-forming shock waves do not impinge upon surface 46. Accordingly, surface 46 may be considered an unprocessed area, at least with respect to the laser shock processing that affects surface 40. Alternately, surface 46 may receive some laser shock processing. Additionally, surface 40 and surface 46 may be distinct from one another (i.e., non-overlapping) or they may overlap at least in part.

It is seen that the removal technique evident in FIG. 5 will typically require that surface 40 and surface 46 be disposed in angular relationship to one another.

Additionally, as surfaces 40 and 46 become increasingly coplanar, the removal method will correspondingly require a higher level of directionality in the material removal process. By contrast, in the generally orthogonal relationship depicted in FIG. 5, a simple machining action oriented perpendicularly to surface 46 will readily accomplish the desired removal of portion 50.

Figure 7:
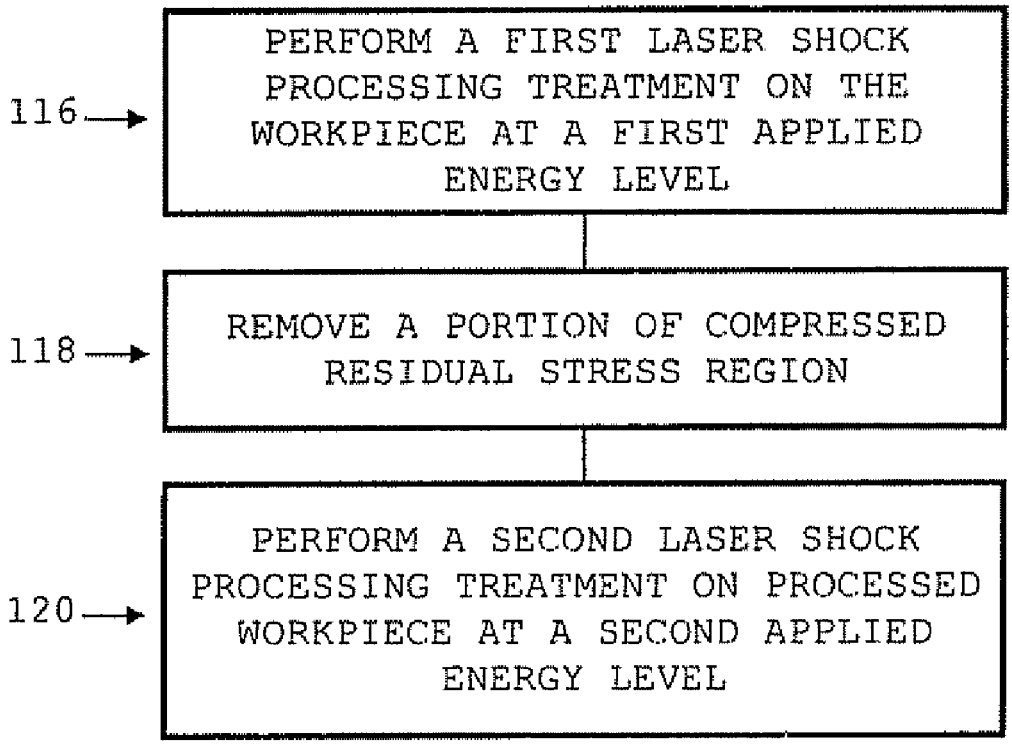
FIG. 7 is a flowchart of one alternative processing method that involves variable-intensity laser shock processing operations, which precede and follow part modification, according to another embodiment of the present invention.

Reference is now made to FIG. 7, which sets forth a flowchart describing the operating sequence of a part modification procedure that involves a further laser shock processing treatment, according to another embodiment of the present invention. This procedure may be used in conjunction with any of the material removal techniques described above concerning FIGS. 1-6 or otherwise.

According to the part modification procedure, the fabricated workpiece is initially subjected to a first laser shock processing treatment, which applies a first energy level or density to the workpiece (step 116). In a manner similar to that described hereinabove, there is removed from the processed workpiece at least a portion of the compressed residual stress region formed by the first laser shock processing treatment (step 118). Following the removal step, the processed workpiece is next subjected to a second laser shock processing treatment which applies a second energy level or density to the workpiece, preferably at the newly exposed surface of the processed workpiece (step 120).

In a preferred form, the first energy density is greater than the second energy density. In particular, the first laser peening treatment preferably involves a high-intensity lasing operation while the second laser peening treatment involves a low-intensity laser peening operation. An optional step may be used to remove additional material from the compressed residual stress region that extends from the newly exposed surface of the processed workpiece. A processing cycle involving such iterations of material removal and low-intensity laser peening treatment may be repeated to obtain certain compressive residual stress profiles within the workpiece. Material may also be added to the processed workpiece at any stage of manufacturing.

The low-intensity laser shock processing serves to provide additional fatigue strength, hardness, and corrosion resistance properties without further deforming the surface in any meaningful way.

Figure 8:
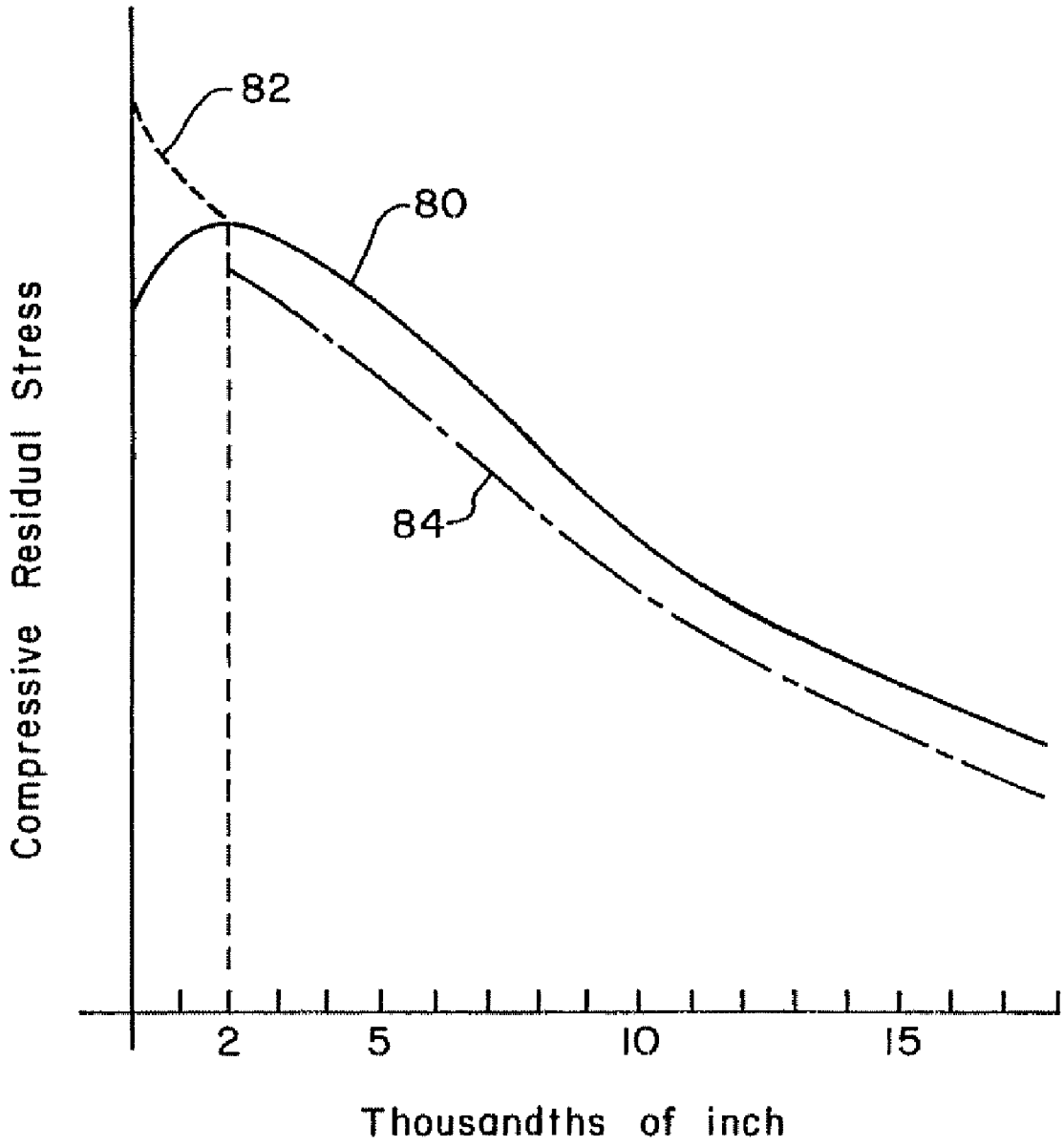
FIG. 8 is a graph illustrating the variation in compressive residual stress values as a function of penetration depth below a laser shock processed surface.

Several synergistic effects have been observed in consequence of the various removal procedures outlined above. For this purpose, reference is made to the graph of FIG. 8 illustrating the variation in residual compressive stress 80 as a function of penetration depth into the workpiece as sometimes measured from the laser shock processed surface. As shown, stress curve 80 sometimes exhibits a hook-type behavior within the first 0.002" of penetration into the compressive residual stress region. This hook-type feature is characterized by a short rise in the stress value over a shallow penetration depth until reaching a maximum stress value, at which point the stress value declines fairly rapidly with increasing distance from the processed surface.

The presence of this sub-maximal stress range in the immediate proximity of the laser shock processed surface is not optimal because it is precisely within this initial depth range that the highest possible stress values are needed to counteract or oppose any defects, such as cracks, imperfections, and other irregularities that may contribute to or precipitate the occurrence of failure or fatigue.

According to a preferred aspect of the present invention, the part modification procedures described above are adapted to ensure that the depth of material removal corresponds to the depth at which the compressive residual stress value exhibits a maximum or near-maximum value, as determined from graph 80 or any suitably equivalent data. Thus, at a depth of approximately 0.002" (namely, at the newly-exposed workpiece surface within the stress region), the workpiece will provide its maximum resistance to the formation or propagation of defects due to the presence of the maximum surface compressive residual stress value at this point.

According to another preferred aspect of the present invention, after completion of the removal step, a material layer may be deposited on the newly-exposed workpiece surface (discussed infra in connection with FIGS. 9-10), followed by an additional laser shock processing treatment that processes the newly-deposited material layer. The result is the formation of a new compressive residual stress region (within the deposited material layer) that exhibits the stress behavior indicated by curve 82 adjoined to curve 80 at its peak value. As shown, it is possible to change the residual stress characteristics at the workpiece surface.

Returning to the stress curve 80, it has also been observed that the near-surface portion of the compressive residual stress region that experiences the initial sub-maximal stress range contains various local tensile residual stresses. Accordingly, removing this leading portion of the stress region immediately beneath the laser shock processed surface enables the tension effects to be eliminated, thereby increasing the average compressive surface residual stress.

However, in response to this removal, the workpiece experiences a relaxation effect in which the existing elastic residual stresses arrive at a new mechanically stable equilibrium condition. This relaxation may uniformly reduce the compressive residual stress levels, as evidenced by a shift in stress curve 80 to a relaxation curve 84.

In sum, as shown by the graph of FIG. 8, the highest value for the compressive residual stress is sometimes found between one and three thousandths of an inch below the laser shock processed surface of the workpiece; however, the value for compressive residual stress may peak at greater depths, such as five thousandths of an inch, depending on the material used and the application of the laser peening process.

When this occurs, it may therefore be advantageous to remove a surface layer within the laser shock processed region, such that a subsurface portion having increased values for compressive residual stress is made the new surface layer of the workpiece. The decision to remove a surface layer having a sub-maximal residual stress range will typically be based on the needs of the application. For example, when an application necessitates a higher compressive stress immediately below the surface, it may be advantageous to remove only a finite layer, and then subject the workpiece to a low intensity laser peening process for further strengthening.

Figure 9B:
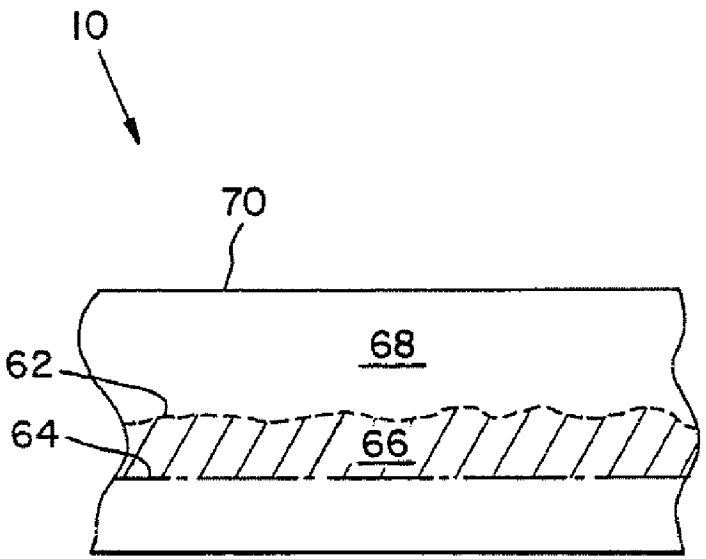
FIGS. 9A and 9B are fragmentary, side-elevational schematic views of a workpiece illustrating the manner of depositing material onto the processed workpiece, according to another embodiment of the present invention.
Figure 9A:
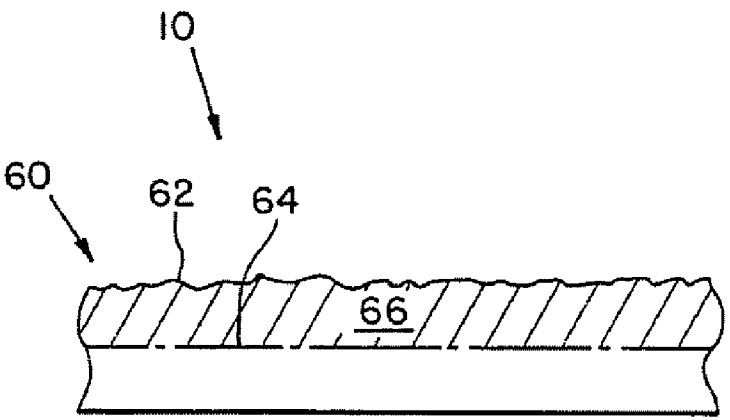
Figure 10:
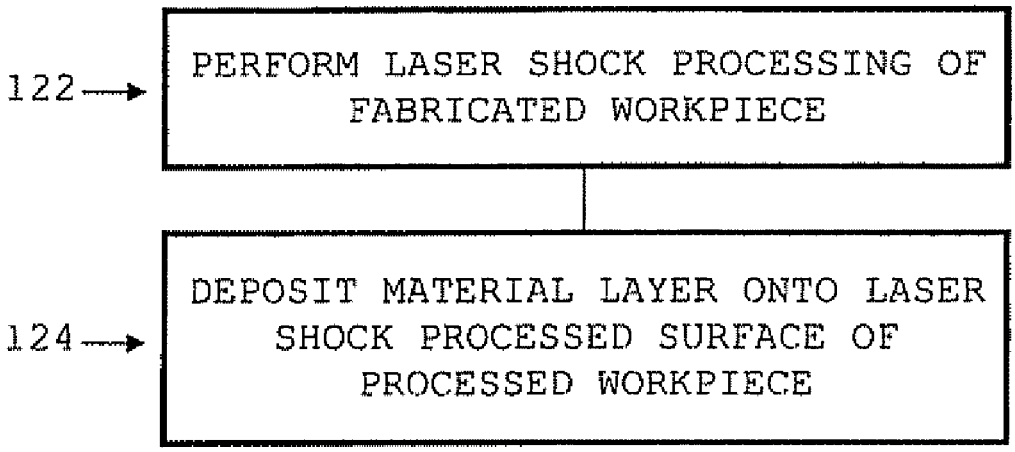
FIG. 10 is a flowchart of the processing method disclosed in FIG. 9.

Referring now to FIGS. 9A and 9B, there are shown fragmentary schematic views of a workpiece 10 illustrating in exaggerated form the manner in which material is deposited onto a laser shock processed surface area of workpiece 10, according to another embodiment of the present invention. Reference is also made to the flowchart of FIG. 10 depicting the operating sequence of the part modification procedure.

Referring first to FIG. 9A, the illustrated workpiece 10 has previously been subjected to laser shock processing at side 60 to conventionally produce a laser shock processed surface area 62 (step 122). As conventionally known, the laser shock processing induces the formation of deep compressive residual stresses extending from surface 62 into the body of workpiece 10 and reaching a penetration depth illustratively designated by subsurface 64, thereby defining an illustrative compressive residual stress region 66 between subsurface 64 and exposed surface 62.

According to another aspect of the present invention, the processed workpiece 10 of FIG. 9A is modified by depositing a material formation or layer 68 upon the laser shock processed surface 62, as shown in FIG. 9B (step 124). One advantage of such part modification procedure involves the ability to precisely form layer 68 in any suitable manner utilizing the appropriate layer formation technology known to those skilled in the art. For example, workpiece 10 in FIG. 9B can be provided with a highly finished and polished upper surface 70 substantially free of defects, irregularities, and other such imperfections. Additionally, the material, properties, geometry, and dimensions of layer 68 may be suitably chosen to achieve a variety purposes tailored to particular applications.

It should be apparent that any suitable technique may be used to form material layer 68, including, but not limited to, flame sprayed coating, plasma sprayed coating, chemical plating, electroplating, vacuum deposition, and chemical vapor deposition. Additionally, any of various material finishing techniques may be used to process the surface of material layer 68. It is also possible to process the workpiece configuration shown in FIG. 9B in conjunction with any of the aforementioned part modification procedures. For example, material layer 68 could be subject to a sequence of laser shock processing and material removal and/or deposition steps.

It is a general feature of the present invention that the part modification procedures disclosed herein may be used to change the residual stress characteristics of the workpiece surface. Additional, the modification procedures may be combined with another.

The present invention finds particular use in applications where the workpiece corresponds to an assembly or a gas turbine engine component. The workpiece may also be a mold, a die, or any other solid body.

While this invention has been described as having a preferred design, the present invention can be further modified within the spirit and scope of this disclosure.

This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for processing a workpiece, comprising:

laser shock processing the workpiece to produce a processed workpiece having at least one laser shock processed workpiece region having compressive residual stress; and removing workpiece material from the at least one laser shock processed workpiece region of the processed workpiece.

2. The method of claim 1, wherein the at least one laser shock processed workpiece region has compressive residual stresses extending into the processed workpiece from a laser shock processed workpiece surface of the processed workpiece.

3. The method of claim 2, wherein the removing workpiece material comprises removing workpiece material from the laser shock processed workpiece surface.

4. The method of claim 3, wherein a subsurface layer of the processed workpiece exposed by the removing workpiece material has a greater compressive residual stress value than the laser shock processed workpiece surface removed by the removing workpiece material.

5. The method of claim 2, further comprising:

determining a penetration depth into the processed workpiece and defining a workpiece subsurface representative thereof at which the processed workpiece exhibits a selective compressive residual stress, the removing workpiece material exposing at least a portion of the defined workpiece subsurface.

6. The method of claim 1, the removing workpiece material providing a selectable penetration depth profile in the processed workpiece.

7. The method of claim 1, wherein the removing workpiece material comprises removing at least one present residual tensile stress field from the at least one laser shock processed workpiece region.

8. The method of claim 1, wherein the removing workpiece material comprises removing an amount of workpiece material sufficient to produce in the processed workpiece at least one selected dimensional characteristic.

9. The method of claim 1, further comprising:

laser shock processing the processed workpiece following completion of the removing workpiece material.

10. The method of claim 9, wherein the laser shock processing of the processed workpiece is performed at a second processing condition different from a first processing condition associated with the laser shock processing that produced the processed workpiece.

11. The method of claim 10, wherein the first processing condition is associated with a lasing intensity level greater than a lasing intensity level associated with the second processing condition.

12. The method of claim 1, wherein the at least one laser shock processed workpiece region extends into the processed workpiece from a first surface of the processed workpiece, the first surface of the processed workpiece having at least one laser shock processed portion.

13. The method of claim 12, wherein the removing workpiece material comprises removing workpiece material from the at least one laser shock processed portion of the first surface of the processed workpiece.

14. The method of claim 12, wherein the removing workpeice material comprises removing workpiece material from a second surface of the processed workpiece different from the first surface of the processed workpiece.

15. The method of claim 14, wherein the second surface of the processed workpiece has at least one portion that is substantially unaffected by the laser shock processing.

16. The method of claim 1, wherein the laser shock processing comprises directing energy toward a first surface of the workpiece, wherein substantially no part of the directed energy impinges on a second surface of the workpiece.

17. The method of claim 1, wherein the workpiece comprises a gas turbine engine component.

18. The method of claim 17, wherein the gas turbine engine component comprises an airfoil.

19. The method of claim 1, wherein the workpiece comprises a mold.

20. The method of claim 1, wherein the workpiece comprises a die.

21. The method of claim 1, wherein the removing workpiece material comprises chemically processing a surface of the processed workpiece.

22. The method of claim 1, wherein the removing workpiece material comprises machining a surface of the processed workpiece.

23. The method of claim 1, wherein the removing workpiece material comprises at least one of: grinding, sanding, mechanical milling, chemical milling, electro-chemical milling, chemical etching, polishing, and thermally treating the processed workpiece.

24. The method of claim 1, wherein the removing workpiece material comprises removing more than 0.0005 inches of workpiece material.

25. A method for processing a workpiece, comprising:

laser shock processing the workpiece to produce a processed workpiece having at least one laser shock processed workpiece region having compressive residual stress;

removing workpiece material from the at least one laser shock processed workpiece region of the processed workpiece; and depositing at least one material layer on at least a portion of the at least one laser shock processed workpiece region of the processed workpiece from which the workpiece material was removed.

26. The method of claim 25, wherein the depositing at least one material layer comprises at least one of: flame spray coating, plasma spray coating, chemical plating, electro-plating, vacuum deposition, and chemical vapor deposition.

27. The method of claim 25, wherein the workpiece comprises a gas turbine engine component.

28. The method of claim 25, wherein the workpiece comprises an airfoil.

29. The method of claim 25, wherein the workpiece comprises a mold.

30. The method of claim 25, wherein the workpiece comprises a die.

31. The method of claim 30, wherein the depositing at least one material layer comprises placing a material upon the die which is subject to physical working.

32. The method of claim 25, further comprising laser shock processing at least a portion of the at least one deposited material layer.

33. The method of claim 25, further comprising removing a portion of the at least one deposited material layer.

34. The method of claim 33, further comprising laser shock processing the processed workpiece following the removing a portion of the at least one deposited material layer.

35. The method of claim 25, further comprising laser shock processing the processed workpiece following the depositing at least one material layer.

* * * * *